US005515708A

United States Patent [19]

D'Agostino

[11] Patent Number: 5,515,708

[45] Date of Patent: May 14, 1996

[54] ROLL-FORMING DIE FOR HELICAL GEARS

[75] Inventor: Charles T. D'Agostino, Rochester, N.Y.

[73] Assignee: Zexel Torsen Inc., Rochester, N.Y.

[21] Appl. No.: 271,067

[22] Filed: Jul. 5, 1994

[51] Int. Cl.[6] ..... B21B 27/00; B21D 15/00; B21H 3/04

[52] U.S. Cl. ..... 72/102; 72/469

[58] Field of Search ..... 72/110, 108, 104, 72/103, 102, 98, 95, 469

[56] References Cited

U.S. PATENT DOCUMENTS

| | | | |
|---|---|---|---|
| 859,643 | 7/1907 | Cummings | 72/103 |
| 2,011,761 | 8/1935 | Handel | 72/95 |
| 3,626,733 | 12/1971 | Zook et al. | 72/104 |
| 3,651,678 | 3/1972 | Zook et al. | 72/103 |
| 5,182,937 | 2/1993 | Dickson | 72/103 |

OTHER PUBLICATIONS

"Roll Forming of Gears at Ford Motor Company", by Leon N. DeVos, Chapter 25, American Gear Manufacturers Association, VA, pp. 335–343.

*Primary Examiner*—Lowell A. Larson
*Assistant Examiner*—Rodney Butler
*Attorney, Agent, or Firm*—Eugene Stephens & Associates

[57] ABSTRACT

Four different designs for the teeth of a rolling die are disclosed. A pair of the disclosed dies is used to form helical teeth in a cylindrical rod workpiece. All four of the disclosed die tooth embodiments are variations of a common design feature: Namely, at least one segment of the tooth profile for the first tooth of the start portion of the die is formed with a pressure angle substantially larger than the pressure angle of the final basic profile geometry desired for the teeth, and then the profiles of the successive die teeth for the start portion are formed so that the pressure angle of each successive die tooth progressively and gradually decreases in magnitude from the pressure angle of the first tooth until the pressure angle of the final die tooth of the start section is substantially the same as the pressure angle of the desired workpiece teeth.

10 Claims, 3 Drawing Sheets

ROLL-FORMING DIE FOR HELICAL GEARS

TECHNICAL FIELD

The invention relates to the roll-forming manufacture of helical gears and, more particularly, to the design of dies appropriate for such manufacturing processes.

BACKGROUND OF THE INVENTION

It has long been common practice to manufacture screws and other threaded fasteners by roll-forming, and in recent decades similar roll-forming processes have been used in the manufacture of helical-tooth gears from cylindrical rod workpieces. In these well-known rolling processes, the toothed articles are formed by the relative motion of sets of dies which themselves have helical teeth that not only displace the metal on the surface of the rods but also pull the rod through the dies during the forming process. Some processes use a pair of flat dies that are reciprocated relative to each other, while others use sets of large cylindrical dies that roll in the same direction, squeezing the workpiece rod between them to form mating teeth on the surface of the rod as the rod rotates between them like a planetary gear.

Such known rolling dies have a "start" portion with a plurality of die teeth having tooth profiles designed with (a) predetermined pressure angles and (b) respective working depths that progressively increase from a first tooth through a final tooth of the start portion. The profile of the final tooth of the start portion is provided with a pressure angle and working depth substantially equivalent to the final profile geometry desired for the teeth of the workpiece being manufactured. Immediately following the start portion of such rolling dies is a "dwell" portion which also includes a plurality of die teeth; and the teeth of the dwell portion, like the final die tooth of the start portion, are also designed to have substantially the same profile geometry desired for the teeth of the workpiece that is being rolled.

A major problem that has affected such prior art rolling systems relates to a undesirable seam or fissure that is formed at the crest of the rolled tooth because the metal of the workpiece is squeezed radially outward faster along the tooth faces of the die teeth than it is moved outwardly in the spaces between the die teeth. This creates two peaks of work material at the roots of each pair of die teeth (i.e., at the top land of the formed tooth); and in the final stages of the roll-forming operation, these peaks fold over to form a seam. The resulting seam creates a potential weak spot that can cause a failure of the formed tooth under certain types of heavy loading.

In an attempt to overcome this problem, some prior art rolling dies (see U.S. Pat. No. 3,626,733 issued to E. S. Zook et al. in 1971, and U.S. Pat. No. 5,182,937 issued to J. F. Dickson in 1993) vary the pressure angle of the tooth profiles of the teeth used in the start portion of the rolling dies. Namely, the entire profile of the whole depth of the initial tooth of the start portion is provided with a pressure angle that is substantially larger than the pressure angle of teeth desired for the workpiece being manufactured; and then, as the respective whole depth of each successive tooth of the start portion gradually increases, this same larger pressure angle is gradually replaced by the final pressure angle desired for the workpiece being manufactured. That is, this successive, tooth-by-tooth replacement of the larger pressure angle by the final pressure angle begins at the lower end of the profile dedendum of one of the shorter teeth of the start portion while the remainder of the profile of the same tooth has the larger pressure angle. Thereafter, as this change progresses, all of the dedendum of a successive die tooth is formed with the final pressure angle while all of the addendum retains the larger pressure angle, until—for the die teeth near the end of the start portion—only the upper addendum retains the larger pressure angle; and finally, the entire tooth profile has been replaced with the final pressure angle.

The use of two different pressure angles, as just explained above, was intended to direct the flow of the workpiece metal in a manner that reduced its propensity to fold into a seam at the crest of the formed tooth. The invention herein is also directed to the elimination of the undesirable folding of the flowed metal of the workpiece and, thereby, to the manufacture of better quality gears by the rolling die method.

SUMMARY OF THE INVENTION

Four designs are disclosed for the teeth of a gear-rolling die. With each of these designs, as each tooth is progressively formed in the workpiece, the metal that is squeezed to create each of its opposite faces moves out radially at approximately the same speed, avoiding the formation of the undesirable peaks of material referred to above. [NOTE: References made herein to "each tooth", "each successive die tooth", etc., identify die and workpiece teeth as they appear in axial sectional views such as those used in the drawings. Persons skilled in the art will understand that such teeth are not actually separate and individual but rather are linked in a continuous helical (thread-like) form.]

All four of my disclosed die tooth embodiments share a common feature: Namely, in each design the tooth profile for the first tooth of the start portion of the die is formed with a pressure angle substantially larger than the pressure angle of the final basic profile geometry desired for the teeth; and then the profiles of the successive die teeth for the start portion are formed so that the pressure angle of each successive die tooth progressively and, preferably, gradually decreases in magnitude from the pressure angle of the first tooth until the pressure angle of the final die tooth of the start section is substantially the same as the pressure angle of the desired workpiece teeth.

In the first embodiment, this just-described progression of pressure-angle changes is applied to the profile of the full depth of each successive die tooth of the start portion. In the second embodiment, this just-described progression of pressure-angle changes is applied to the profile of only the addendum of each successive die tooth. In the third embodiment, this just-described progression of pressure-angle changes is applied to the profile of only the dedendum of each successive die tooth; and in the fourth embodiment, this just-described progression of pressure-angle changes is applied to the profile of only a section of the addendum of each successive die tooth.

While the incremental metal flow produced by my four different die tooth designs varies slightly from one embodiment to another, all four result in a generally consistent radially outward flow throughout the entire space between each pair of successive die teeth, thereby avoiding the creation of peaks and folds of material at the top lands of the formed teeth, and thus increasing the quality of the roll-formed gears.

DRAWINGS

FIGS. 5, 6, 7, and 8 are, respectively, four different gear-rolling die tooth designs according to the invention, each being illustrated in a schematic cross-sectional view of a workpiece rod being formed with teeth by a gear-rolling die having teeth according to one of the invention's four embodiments.

DETAILED DESCRIPTION OF PREFERRED EMBODIMENTS

Figure 2:
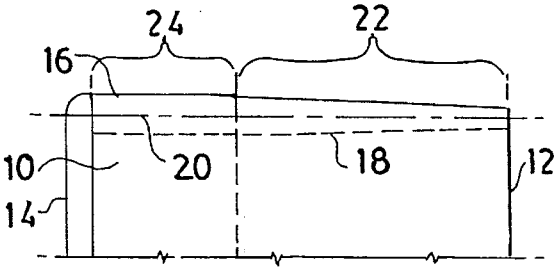
FIGS. 1 and 2 are, respectively, schematic representations of end and side views of one of a pair of gear-rolling dies of the type being improved by the invention.
Figure 1:
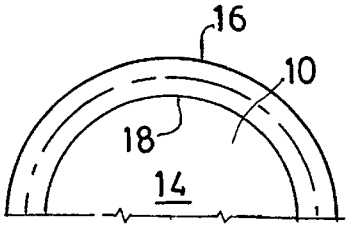

In FIGS. 1 and 2, a gear-rolling die 10 is represented schematically in respective end and side views with the individual gear teeth of the die being omitted. Die 10 is one of a pair of identical dies (the other is not shown) used to roll teeth into a rod-type workpiece. Die 10 has a front end 12 and a rear end 14, and the surface of die 10 has a plurality of gear teeth (not shown) formed with progressively-increasing profile depth as indicated schematically in exaggerated form by top land line 16, root line 18, and pitch line 20.

Each die 10 is positioned in proximity to its identical paired mating die gear, and a workpiece is fed between the die pair, entering at front end 12 as a rod and exiting at rear end 14 with roll-formed teeth. Each die 10 has a start portion 22 in which the die teeth become progressively deeper from front end 12 toward rear end 14, followed by a dwell portion 24 in which the depth and profile of the die teeth (a) are substantially identical to the geometry of the desired workpiece gear teeth and (b) remain substantially constant.

Figure 3:
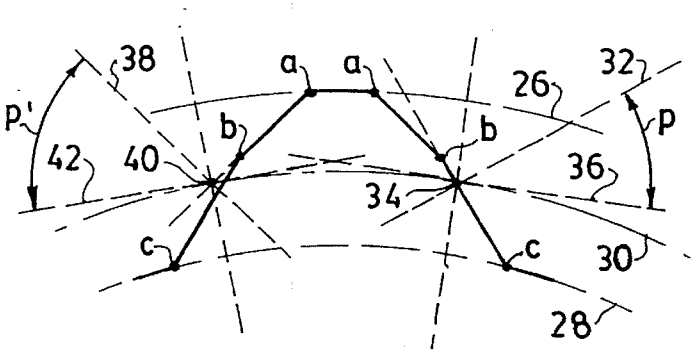
FIG. 3 is a schematic cross-sectional view of one tooth of a gear-rolling die according to the invention, this view being used to define various gear geometry terms used in the specification.

In FIG. 3, a cross-sectional view of one tooth of a gear-rolling die according to the invention is schematically represented, and reference to this drawing is made in the following definitions of certain gear terminology that will be used in describing the invention. The surface of each tooth face of the illustrated gear tooth has a profile that extends from an addendum circle 26 at the top of the tooth to a root circle 28 at the bottom of the tooth; and between them is located the pitch circle 30 of the gear, the latter being on the imaginary pitch cylinder that rolls without slipping with a pitch cylinder of a mating gear.

Most of the terms used herein are standard gear nomenclature as published by the American Gear Manufacturers Association. That portion of each tooth profile that lies between addendum circle 26 and pitch cylinder/circle 30 is called the "addendum", while that portion that lies between pitch circle 30 and root circle 28 is called the "dedendum". In general, the "pressure angle" of a tooth is the angle formed between a line normal to a pitch point (i.e., a point on the surface of the tooth at the pitch line) and the plane tangent to the pitch cylinder of the gear. For example, for the tooth surface profile illustrated in FIG. 3, the segment bc has a pressure angle p measured between a line 32, which is drawn perpendicular to segment bc at a pitch point 34, and a plane 36, which is tangent to the pitch cylinder 30 at pitch point 34.

However, as used herein, the term "pressure angle" is also used with a slightly different definition. Namely, in FIG. 3 segment ab does not comprise the entire addendum of the tooth; and, therefore, segment ab does not itself include a pitch point. As used herein, the pressure angle of segment ab is measured with a line 38 drawn perpendicular to an extension of segment ab at a point 40, which marks the intersection of segment ab extended with pitch cylinder 30. The measurement is made between normal line 38 and a plane 42, which is tangent to pitch cylinder 30 at point 40.

Figure 4:
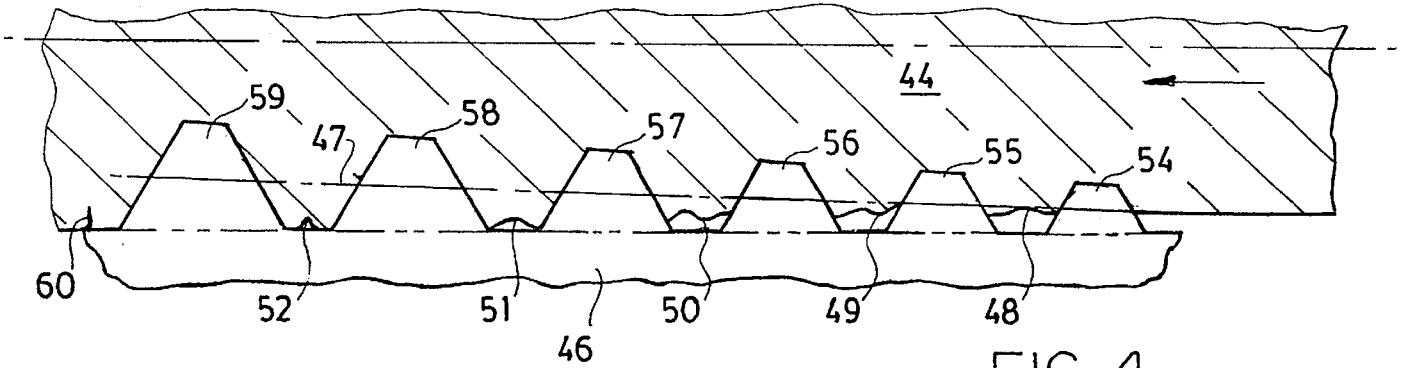
FIG. 4 PRIOR ART
FIG. 4 is a schematic cross-sectional view of a workpiece rod being formed with teeth by a well-known prior art gear-rolling die.

FIG. 4 illustrates, schematically, a cross-sectional view of a workpiece rod 44 being formed with teeth by the start portion of a conventional prior art gear-rolling die 46 which includes a plurality of die teeth having tooth profiles designed with (a) pressure angles substantially equivalent to the pressure angles desired for the teeth being formed in the workpiece and (b) respective working depths that progressively increase from right-to-left in the drawing. The variably-dashed line 47 represents the line of contact between the imaginary pitch cylinders of gear workpiece 44 and gear die 46.

As can be seen from the top lands 48, 49, 50, 51, and 52 of the successive teeth being formed in workpiece rod 44, the forces exerted by the dies cause the radially outward movement of the metal of rod 44 to be faster along the faces of each respective die tooth 54, 55, 56, 57, 58, and 59 than is its movement nearer the center of the space between each die tooth. Due to this uneven rate of movement, the top lands 50 and 51 have noticeable depressions that increase in steepness significantly at top land 52 and that end up as a seam or fissure 60 in the top land of the fully-formed tooth. As indicated above, seam 60 creates a potential weak spot that can cause a failure of the formed tooth under certain types of heavy loading.

Figure 5:
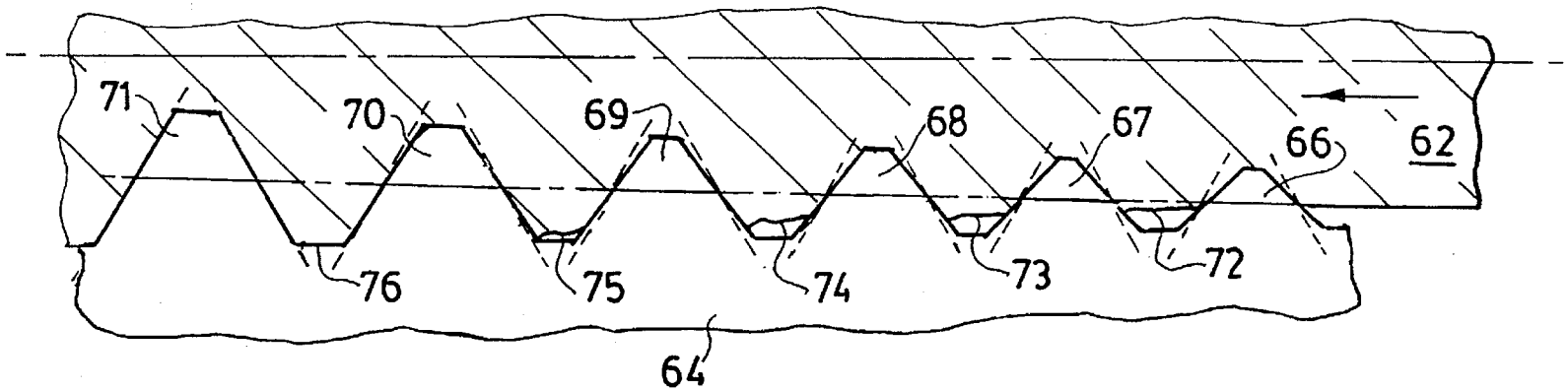

FIG. 5 is a schematic illustration similar to FIG. 4, showing a cross-sectional view of a workpiece rod 62 being formed with teeth by a rolling-die 64 having tooth profiles designed in accordance with a basic embodiment of the invention. The first tooth 66 of the start portion of die 64 has its tooth faces formed with a pressure angle (e.g., 46°) that is substantially larger than the final pressure angle (e.g., 28°) desired for the teeth being formed in the workpiece. That final desired pressure angle is indicated in FIG. 5 by the dashed lines superimposed over the working faces of each of the illustrated die teeth.

Following first tooth 66, each successive die tooth 67, 68, 69, and 70 is designed so that the pressure angle of each said successive die tooth progressively and gradually decreases in magnitude from the pressure angle of the first tooth until, at tooth 71, the pressure angle is substantially the same as the desired final pressure angle. As indicated above, the remaining teeth of the start portion and all the teeth of the following dwell portion of rolling-die 64 (not shown in FIG. 5) are all designed with substantially the same profile geometry as is desired for the teeth being formed in the workpiece.

As can be seen from the shape of the top lands 72, 73, 74, and 75 of the successive teeth being formed in workpiece rod 64, this just-described gradual and progressive decrease in the pressure angle of the successive die teeth results in a relatively even radially outward movement of the metal of rod 62 along the faces of the die teeth and also in the center of the space between each die tooth. With this more even rate of movement, the top lands 74 and 75 are not formed with noticeable depressions; and, as can be seen from top land 76, the top lands of the fully-formed teeth do not end up with seams.

Figure 6:
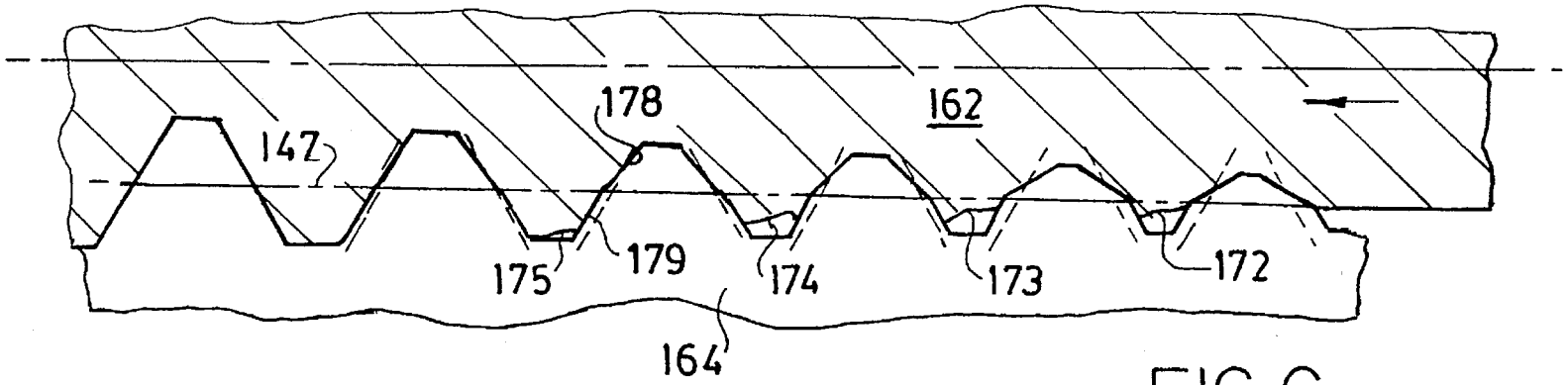
Figure 7:
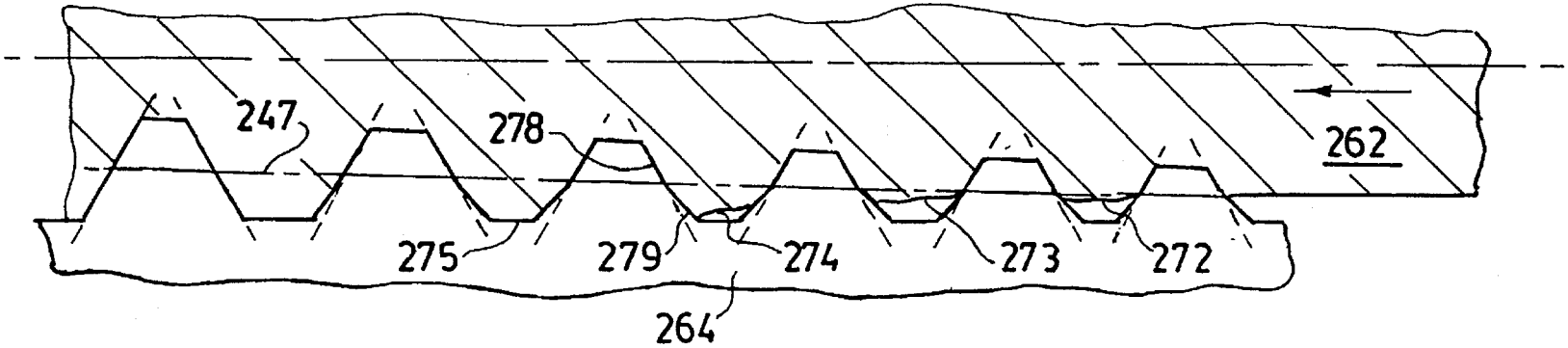
Figure 8:
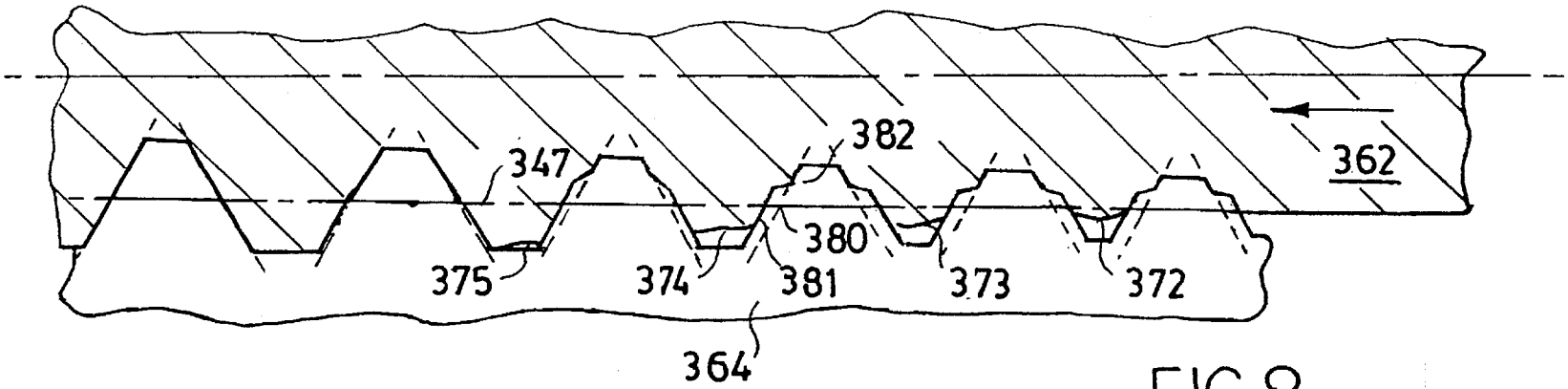

Three further embodiments of the invention are illustrated in FIGS. 6, 7, and 8; and each utilizes the same basic concept shown in FIG. 5. Namely, beginning with a substantially larger pressure angle for the first tooth of the start section, each successive die tooth is designed with a gradually and progressively changing pressure angle until reaching the final shape desired for the teeth being formed. However, in the embodiment shown in FIG. 6, the entire addendum, but the addendum only, of each successive tooth of die 164 is designed with this gradual change in pressure angle; in the embodiment shown in FIG. 7, the entire dedendum, but the dedendum only, of each successive tooth of die 264 is designed with this gradual change in pressure angle; and, in the embodiment shown in FIG. 8, only a section of the addendum profile of each successive tooth of die 364 is changed in this manner. In the drawings, the variably-dashed lines 147, 247, and 347 represent, respectively, the line of contact between the imaginary pitch cylinders of gear workpieces 162, 262, 362 and gear dies 164, 264, 364. As explained above, pitch lines 147, 247, 347 denote the respective boundary between the addendum and dedendum of each respective tooth.

In FIGS. 6, 7, and 8, the final desired pressure angle is again superimposed on each die tooth in dashed lines to facilitate visualization of the progressively changing pressure angle on the affected section of each tooth profile. In the die design of FIG. 6, while the pressure angle of the addendum 178 of each tooth is progressively decreasing, all of the die teeth are provided with a dedendum 179 having a pressure angle that is substantially equal to the finally-desired pressure angle. Contrarily, in the die design of FIG. 7, while the pressure angle of the dedendum 279 of each tooth is progressively decreasing, all of the die teeth are provided with an addendum 278 having a pressure angle that is substantially equal to the finally-desired pressure angle.

In the FIG. 8 die design, only a section 380 of the addendum of each tooth is provided with the progressively decreasing pressure angle, while the remaining sections 381 and 382 of the profile of each tooth surface have a pressure angle that is substantially equal to the pressure angle desired for the finished workpiece. As illustrated in FIG. 8, progressively changing section 380 of each die tooth is positioned centrally of its respective addendum and, in this particular design, constitutes 50% of the addendum. However, in preferred embodiments section 380 may constitute anywhere from 40% to 60% of the addendum.

In FIGS. 6, 7, and 8, it can be seen from top lands (172, 173, 174, 175; 272, 273, 274, 275; and 372, 373, 374, 375, respectively, that these embodiments also result in a fairly even rate of movement of the metal of respective workpieces 162, 262, 362 along and between the teeth of rolling dies 164, 264, 364. While this metal movement varies slightly from one to another of the four disclosed die designs, all of the designs avoid the formation of peaks of material on the top lands and, thereby, avoid the problem of undesirable seams.

I claim:

1. In a roll-forming die for creating helical teeth in a workpiece, said die having a start portion with a plurality of die teeth having tooth profiles with predetermined pressure angles and respective working depths that progressively increase from a first tooth through a final tooth, said final tooth of said start portion having a profile with a pressure angle and working depth substantially equivalent to a final basic profile geometry desired for each of said helical workpiece teeth, and a dwell portion with a plurality of die teeth all having substantially said final basic profile geometry, an improved profile geometry for the die teeth of said start portion comprising:

a tooth profile for said first tooth of said start portion formed with a pressure angle substantially larger than the pressure angle of said teeth having said final basic profile geometry; and each successive die tooth for said start portion having a respective tooth profile formed with a pressure angle that is progressively smaller than the pressure angle of each preceding tooth so that said pressure angle of each said successive die tooth progressively decreases in magnitude from said pressure angle of said first tooth to said pressure angle of said final die tooth.

2. The roll-forming die of claim 1 wherein:

said profile of each said die tooth preceding said final die tooth of said start portion has an addendum and a dedendum, each said addendum and dedendum having a different respective pressure angle;

said pressure angle of the addendum only of the tooth profile for said first tooth of said start portion is formed with said pressure angle substantially larger than the pressure angle of said teeth in said dwell portion; and said pressure angle of the addendum only of each said successive die tooth progressively decreases in magnitude from said addendum pressure angle of said first tooth until the pressure angle of the addendum of said final die tooth is substantially the same as the pressure angle of said teeth in said dwell portion.

3. The roll-forming die of claim 1 wherein:

said profile of each said die tooth preceding said final die tooth of said start portion has an addendum and a dedendum, each said addendum and dedendum having a different respective pressure angle;

said pressure angle of the dedendum only of the tooth profile for said first tooth of said start portion is formed with said pressure angle substantially larger than the pressure angle of said teeth in said dwell portion; and said pressure angle of the dedendum only of each said successive die tooth progressively decreases in magnitude from said dedendum pressure angle of said first tooth until the pressure angle of the dedendum of said final die tooth is substantially the same as the pressure angle of said teeth in said dwell portion.

4. The roll-forming die of claim 1 wherein:

said profile of each said die tooth preceding said final die tooth of said start portion has an addendum and a dedendum, each said addendum and dedendum having a different respective pressure angle;

only a segment of said addendum of the tooth profile for said first tooth of said start portion is formed with said pressure angle substantially larger than the pressure angle of said teeth in said dwell portion; and said pressure angle of only said addendum segment of each said successive die tooth progressively decreases in magnitude from said pressure angle of said addendum segment of said first tooth until said addendum segment of said final die tooth is substantially the same angle as the pressure angle of said teeth in said dwell portion.

5. The roll-forming die of claim 1 wherein said pressure angle of said teeth in said dwell portion is selected from the range of 25°–30° and said pressure angle of the tooth profile for said first tooth of said start portion is increased by 16°–20° more than said selected dwell portion pressure angle.

6. The roll-forming die of claim 2 wherein:

said pressure angle of said dedendum profile of each said die tooth of said start portion is substantially the same angle as the pressure angle of said teeth in said dwell portion.

7. The roll-forming die of claim 3 wherein:

said pressure angle of said addendum profile of each said die tooth of said start portion is substantially the same angle as the pressure angle of said teeth in said dwell portion.

8. The roll-forming die of claim 4 wherein each said die tooth has an addendum circle and a pitch circle and each said addendum segment is positioned at predetermined distances above said pitch circle and below said addendum circle.

9. The roll-forming die of claim 8 wherein each said addendum segment is positioned centrally of its respective addendum.

10. The roll-forming die of claim 9 wherein each said addendum segment comprises between 40% and 60% of its respective addendum.

* * * * *